United States Patent [19]

deNora

[11] 4,389,289

[45] Jun. 21, 1983

[54] BIPOLAR ELECTROLYZER

[75] Inventor: Oronzio deNora, Milan, Italy

[73] Assignee: Oronzio deNora Impianti Elettrochimici S.p.A., Milan, Italy

[21] Appl. No.: 224,906

[22] Filed: Jan. 14, 1981

[30] Foreign Application Priority Data

Jan. 16, 1980 [IT] Italy ..... 19225 A/80

[51] Int. Cl.[3] ..... C25B 1/26; C25B 1/46; C25B 11/00; C25B 9/04

[52] U.S. Cl. ..... 204/128; 204/255; 204/268; 204/280; 204/282; 204/288; 204/290 R

[58] Field of Search ..... 204/128, 253–256, 204/257–258, 268, 280, 288, 290 R, 282–284

[56] References Cited

U.S. PATENT DOCUMENTS 3,873,437 3/1975 Pulver ..... 204/254
3,948,750 4/1976 Figueras et al. ..... 204/254 X
4,108,752 8/1978 Pohto et al. ..... 204/256
4,247,376 1/1981 Dempsey et al. ..... 204/258 X

FOREIGN PATENT DOCUMENTS 52-48596 4/1977 Japan ..... 204/254
54-151595 11/1979 Japan ..... 204/253

*Primary Examiner*—Donald R. Valentine
*Attorney, Agent, or Firm*—Hammond, Littell, Weissenberger and Muserlian

[57] ABSTRACT

A bipolar diaphragm electrolyzer particularly suitable for electrolysis of alkali metal halide aqueous solutions wherein the bipolar wall separating the electrode compartments is formed of at least two sheets made of different metals, suitable pressure being applied against the metal sheets to provide for electrical continuity across the bipolar wall, said pressure being exerted either by means of resilient elements which are compressed when the electrolyzer is closed or by maintaining the electrode compartments under a sufficient hydrostatic pressure during the electrolytic process.

14 Claims, 4 Drawing Figures

BIPOLAR ELECTROLYZER

STATE OF THE ART

Filter press bipolar electrolyzers are known which have bipolar walls separating the cathodic compartment from the anodic compartment adjacent in the series arrangement of the unit cells and the bipolar walls have secured on one side thereof the cathode structure and on the other side the anode structure. A certain number of said bipolar elements are connected in series to form the electrolyzer with an anode endplate and a cathode endplate at the two ends.

In electrochemical processes wherein the anolyte and the catholyte and the respective electrolysis products must be separated, a permeable diaphragm or a semi-permeable membrane is positioned between the anode of a bipolar element and the cathode of the bipolar element adjacent in the series and electrical continuity between the anode of an unit cell and the cathode of the unit cell adjacent in the series is provided across the bipolar wall. The bipolar wall is therefore cathodically polarized and in contact with the catholyte on one side, while it is anodically polarized and in contact with the anolyte on the other side. Consequently, the two surfaces of the bipolar wall must exhibit quite different corrosion resistance properties to the different electrolytes and to the electrolysis products in contact therewith.

For example, in a two compartment diaphragm cell for the production of chlorine and caustic soda, the parts exposed to chlorine and to the anolyte are usually made of titanium or other valve metal, while mild steel, stainless steel, nickel or other caustic resistant alloys are used for the parts in contact with caustic catholyte and the hydrogen evolved at the cathode.

The use of bipolar walls consisting of mild steel-titanium bimetallic plates obtained by explosion bonding and/or lamination is very costly. To avoid the often prohibitive costs of these bimetal laminates, a construction is often utilized wherein a series of bi- or tri-metallic connectors passes through the steel sheet which has the cathodic structure welded to one side thereof and the anodic structures and the protective titanium sheet are welded to the other side. However, this type of construction involves high fabrication costs.

OBJECTS OF THE INVENTION

It is an object of the invention to provide a new and improved electrolyzer of simple, economical construction, particularly suitable for the electrolysis of alkali metal halide aqueous solution.

It is another object of the invention to provide an improved for electrolysis of aqueous electrolytes, especially aqueous alkali metal halide solutions.

These and other objects and advantages of the invention will become obvious from the following detailed description.

THE INVENTION

The novel bipolar electrolysis cell of the invention is of the diaphragm type comprising a frame made of an electrically inert material provided with means to introduce and remove anolyte and catholyte, an anodic endplate, a cathodic endplate and at least one bipolar element comprised of abutting cathodic plate and anodic plate having secured thereto the cathode structure and the anode structure respectively, the said plates of the bipolar element being pressed in electrical contact with each other by means of pressure.

The anodic plate and the cathodic plate are not mechanically bonded together but are kept in electrical contact with each other by pressing the plates together. The pressure may be exert by resilient elements which press the plates against one another when the electrolyzer is closed for operation or by keeping a sufficient hydrostatic pressure in the electrode compartments during the electrolysis process to press the plates together.

Referring now to the drawings.

Figure 1:
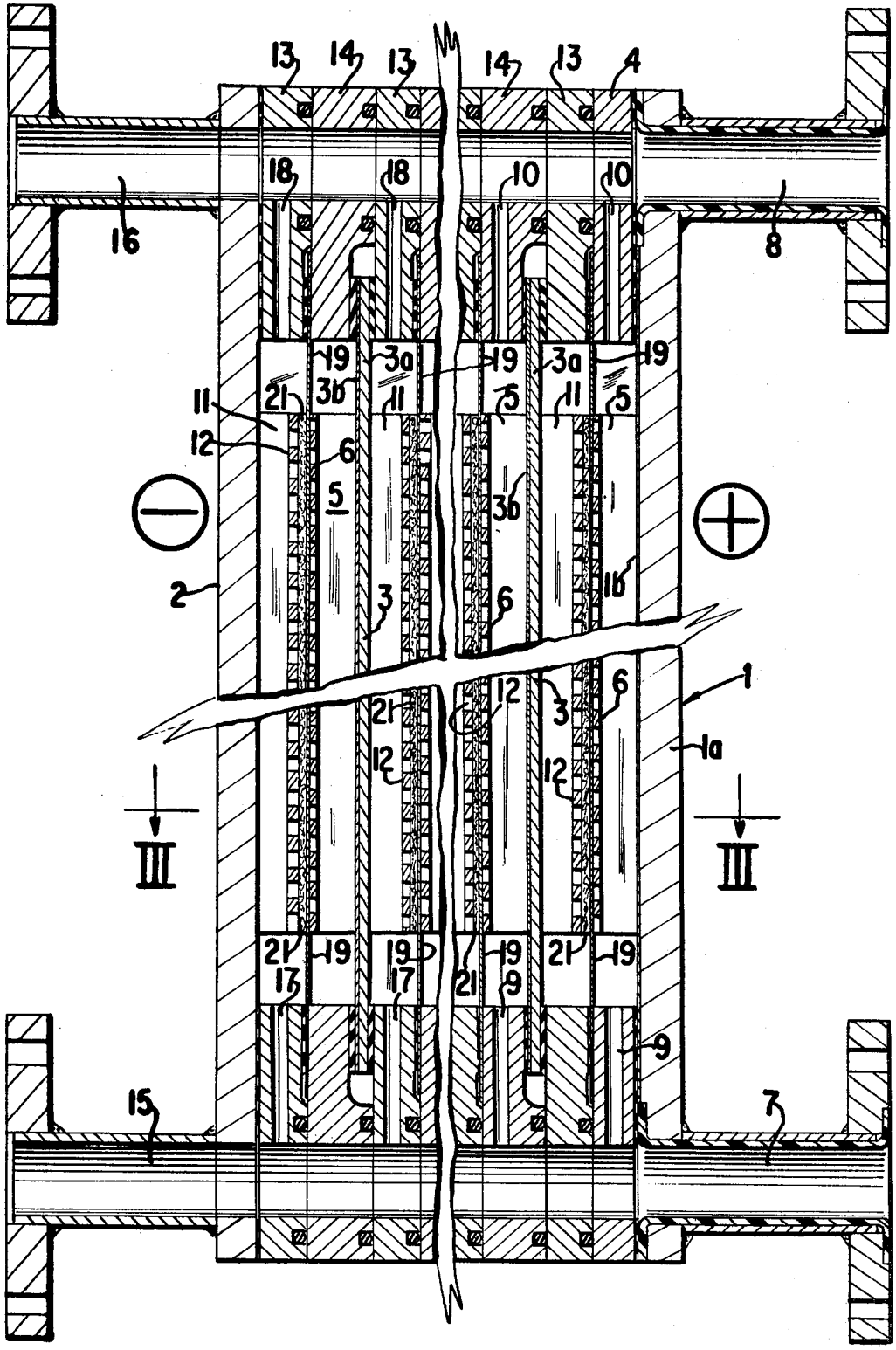
FIG. 1 is a sectional elevation view of an electrolyzer according to the invention.

FIG. 1 illustrates an electrolyzer particularly useful for the electrolysis of an alkali metal halide brine of the invention comprising an anodic endplate 1 connected to the positive pole of an electrical source, a cathodic endplate 2 connected to the negative pole of an electrical source and a series of bipolar elements 3 therebetween. Frames made of inert plastic material define the various electrode compartments. The anodic endplate 1 consists of a steel plate 1*a* and a sheet 1*b* made of titanium or other valve metal sheet which passivates under anodic conditions abutting against the internal surface of the steel sheet.

A series of vertical titanium ribs 5 are welded to the titanium sheet 1*b*, said ribs having welded thereto a screen or expanded sheet 6 made of titanium or other valve metal coated with a film of resistant and non-passivating material, preferably comprising noble metals and oxides thereof as described in U.S. Pat. Nos. 3,711,385 or 3,632,498 for example. A frame 4 made of inert plastic material, preferably polytetrafluoroethylene (PTFE), polychlorotrifluoroethylene (PCTFE), polyvinylidenefluoride (PVDF or $PVF_2$), perfluoroalcoholxylic resin (PFA) or polyvinylchloride (PVC), defines the anodic compartment and is provided with at least four holes drilled across its thickness, two coaxial to anolyte inlet port 7 and two coaxial to anolyte outlet port 8 for withdrawal of depleted anolyte and anodic products. The two ports are connected to the anodic compartment respectively through one or more ports 9 and 10.

Each bipolar element 3 consists of a plate 3*a* made of steel or other cathodic resistant material and a titanium or other valve metal sheet 3*b*. Vertical steel ribs 11 are welded to titanium sheet 3*a* and the said ribs have welded thereto a screen or expanded sheet 12 made of titanium or other valve metal coated with a film of resistant and non-passivating material, preferably comprising valve metals or oxides thereof.

A frame 13 defines the cathodic compartment while a frame 14 defines the anodic compartment and both frames are made of an inert, plastic material, preferably chosen among the materials indicated for frame 4. Frames 4, 13 and 14 are provided with at least four coaxial holes forming ducts, two of which are connected to inlet port 7 and outlet port 8 of the anodic endplate for circulating the anolyte, while the remaining two are connected to outlet ports 15 and 16 of the cathodic endplate for circulating the catholyte. Gaskets of the "O ring" type provide hydraulic sealing. A series of ports 9 and 10 connect the various anodic compartments respectively to duct 7 for the anolyte and duct 8 for withdrawal of the depleted anolyte and anodic products. A series of ports 17 and 18 (as it is shown on the left side portion of the section of FIG. 1, which is sectioned on a different plane with respect to the right side portion) connect the various cathodic compartments respectively to duct 15 for catholyte inert and duct 16 for catholyte and cathodic products outlet.

Diaphragm 19 is held between cathodic frame 13 and anodic frame 14 by interposing gaskets 20 and it preferably consists of a semi-permeable membrane, impervious to gas and liquid flow and permeable to cations. Particularly suitable membranes consist of a film of a copolymer of tetrafluoroethylene and perfluosnlfonylethoxyvinylether having a thickness in the range of 0.3 to 0.5 mm produced by Du Pont de Nemours under the commercial trade name of Nafion. The bipolar metal walls 3 formed by the steel plates 3*a* and the titanium sheets 3*b* are held between the cathodic frames 13 and the anodic frame 14. Suitable gaskets provide for a hydraulic seal to prevent anolyte infiltration between the surfaces in contact of the two metal plates.

According to a preferred embodiment of the present invention, a compressible, resilient mat 21 made of metal wire resistant to the electrolyte and the electrolysis products may be applied onto the cathodic screen 12. For example, a particularly suitable resilient fabric consists of an open knitted fabric of nickel or steel wire having a diameter in the range of 0.1 to 0.7 mm, preferably crimped by forming, so that every single wire forms a series of waves of an amplitude corresponding to the maximum height of the crimping knitted mesh or fabric. One or more knitted mesh or fabrics may be superimposed one upon another to obtain the desired thickness and resilience.

When the electrolyzer is closed by tie rods or pneumatic or hydraulic jacks acting on the anodic and cathodic endplates, the membrane is thus sandwiched between the anodic and cathodic structures and the elastic reaction force exerted by the resilient elements is transmitted to the bipolar walls. The pressure exerted onto the contact surfaces of sheets 3*a* and 3*b* provides the electrical contact between the two sheets and this pressure, due to the elastic reaction force of the resilient elements, is preferably in the range of 100 to 2000 $g/cm^2$ and more preferably in the range of 200 to 800 $g/cm^2$. Within said limits, which can be easily tolerated by the membrane, a good electrical contact is thus established between the two sheets forming the bipolar walls.

Ohmic losses detected between the anodic ribs 5 and the cathodic ribs 11 are quite negligible, generally in the range of 15 to 40 mV at a current density between 100 and 4000 $A/m^2$ of projected electrode areas. The ohmic losses can be furthermore reduced by coating the contact surfaces of the plates 3*a* and 3*b* with a film of copper, tin, silver, platnium or other suitable coating metals by galvanic deposition, spray coating or any equivalent technique. A contact resistivity reduction higher than 50% was achieved with deposits containing from 0.5 to 2 $g/m^2$ of said metals. For example, with a silver deposit of 1 $g/m^2$, the voltage drop detected between anodic ribs 5 and cathodic ribs 11 ranges from 5 to 20 V at current densities between 1000 and 4000 $A/m^2$ of projected electrode areas.

The resilient mat 21 may be applied either onto the cathodic side of the membrane, as illustrated in FIG. 1, or onto the anodic side. In this latter case, it is preferably made of titanium, niobium or other valve metal resistant to anodic conditions and is preferably coated with a non-passivatable material such as noble metal belonging to the platinum group or oxides thereof. The electrodes of the various elementary cells forming the electrolyzer are the electrode screens 6 and 12 and the compressible and resilient metal fabrics 21 where they are utilized.

Alternatively, the electrodes may be directly bonded onto the membrane in the form of thin porous layers of a conducting material, non-passivatable and resistant under electrochemical conditions. In this case, the electrode screens 6 and 12 or the compressible and resilient elements 21 act as current distributors to the electrode bonded onto the membrane surface. Such cells are called solid polymer electrolyte cells, and the resilient elements 21 are extensively described in my copending, commonly assigned U.S. patent application Ser. No. 102,629 filed Dec. 11, 1979 and whose entire description is herewith incorporated by express reference.

The elastic reaction force which maintains a sufficient pressure between the abutting surfaces of plates 3*a* and 3*b* forming the bipolar wall may be provided by means other than the compressed metal wire fabrics 21. For example, the screens or expanded sheets 6 and 12 may be compressed against the membrane 19 without the interposition of the resilient layer 21. In this case, preferably ribs 5 and 11 should be offset one from the other to allow a certain elastic deformation of the electrode screens 6 and 12, as described in copending, commonly assigned U.S. patent application Ser. No. 57,258 filed on July 12, 1979, whose description is herewith incorporated by express reference.

Figure 2:
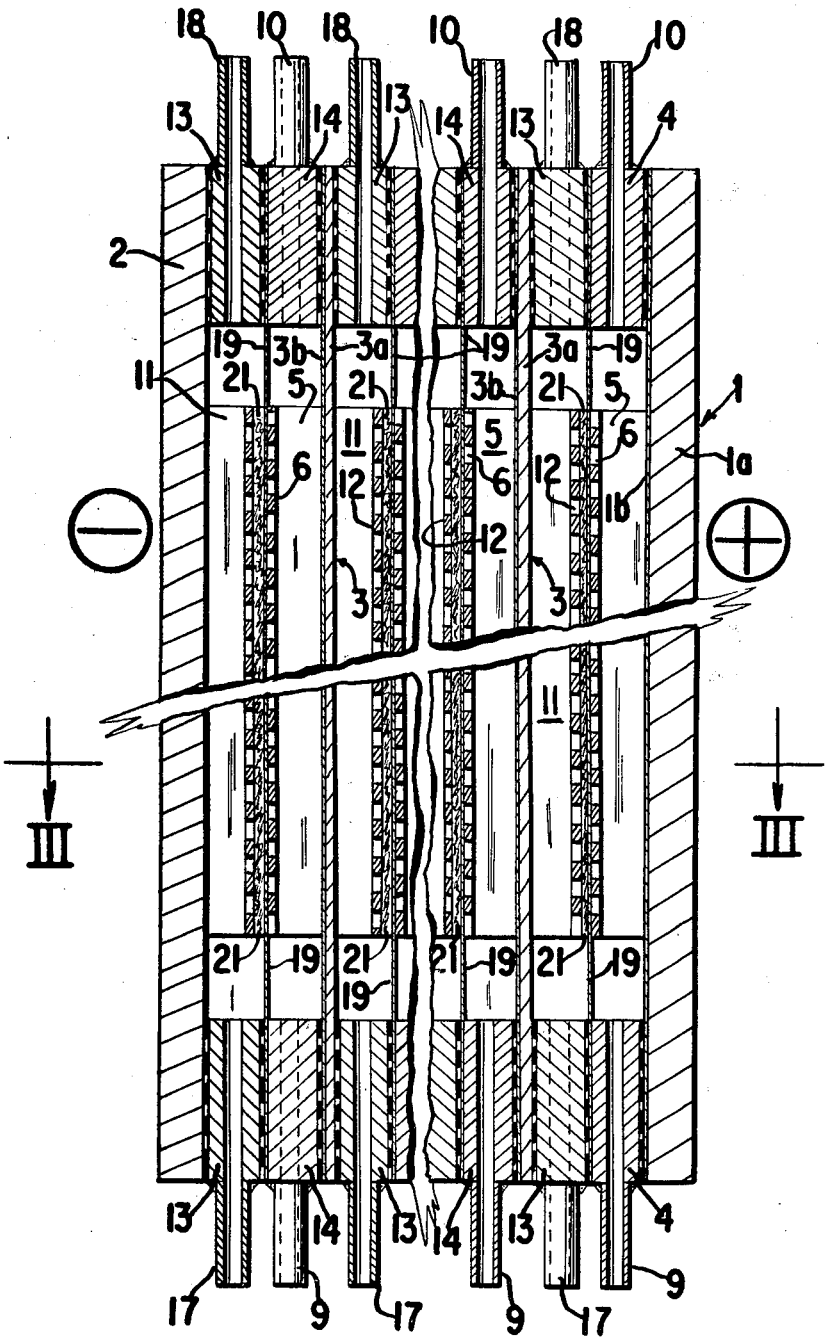
FIG. 2 is a sectional elevation view of a different embodiment of an electrolyzer of the invention.
Figure 3:
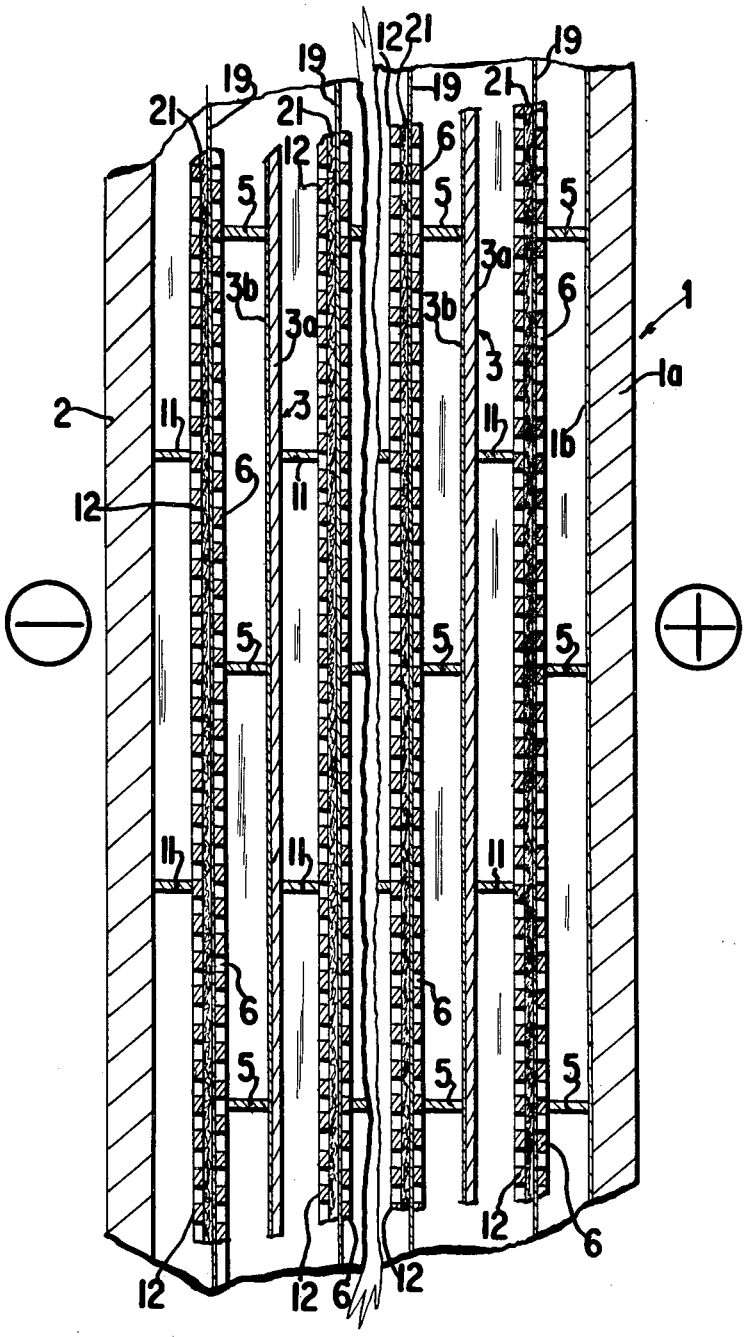
FIG. 3 is a plan view of the electrolyzer of FIG. 1 taken along section line III—III of FIG. 2.

The electrolyzer described in FIG. 2 illustrates a different embodiment of the present invention which is in many aspects similar to the one described in FIG. 1 and the same parts are indicated by the same numbers. The only difference is constituted by the fact that the electrolyzer of FIG. 2 is not provided with internal collectors corresponding to ducts 7,8,15 and 16 of FIG. 1. Electrolyte is circulated through ducts 9 and 10 respectively for anolyte inlet and for the withdrawal of the depleted anolyte and anodic products, while ducts 17 and 18 are respectively for catholyte inlet and for the withdrawal of the catholyte and cathodic products. FIG. 3 is a partial plan view of the electrolyzer described in FIGS. 1 and 2 taken along section line III—III and the same parts are indicated in all the figures by the same numbers.

According to a different embodiment of the present invention, electrical contact between the contact surfaces of plates 3*a* and 3*b* forming the bipolar wall is achieved by maintaining either the anolyte or the catholyte or both under a hydrostatic pressure higher than at least 0.3 atmospheres, preferably in the range of 0.5 to 3 atmospheres.

In this case, the resilient compressible elements are no longer required and the electrical continuity across the bipolar wall is achieved by the pressure acting on the two plates 3*a* and 3*b*. In this case, either or both the electrode screens 6 and 12 may be spaced some millimeters apart from the membrane surfaces by using a gasket 20 of suitable thickness. The opposite electrode compartments may be kept under different hydrostatic pressure, but preferably they should be almost the same so that the pressure differential across the membrane is not so high as to damage the membrane be excessively pushing the membrane against one of the two electrode screens.

Also, by using pressurized compartments, negligeable ohmic drops were detected across the abutting surfaces of the plates 3a and 3b forming the bipolar wall, ranging from 5 to 20 mV at a current density in the range of 1000 to 4000 $A/m^2$ with pressures on the order of 1 atmosphere.

To improve the electrical contact between the surfaces of plates 3a and 3b and, at the same time, to obtain a good dimensional stability of the composite bipolar walls, the two plates 3a and 3b should have rigidity characteristics different from each other. In particular, it is useful to provide a cathodic plate 3a substantially rigid and non-deformable under the applied pressure while the anodic plate should be substantially deformable under the same pressure. In this way, the cathodic plate 3a ensures a substantial dimensional stability of the composite bipolar wall, while the anodic plate 3b, which can warp and slide under pressure, fit and uniformly adheres to the cathodic plate surface ensuring the maximum contact area to the electric current passage through the bipolar wall. For example, titanium anodic plates 3b may have a thickness of 0.5 to 2.5 mm, while the steel plate 3a may have a thickness in the range of 5 to 10 mm.

Figure 4:
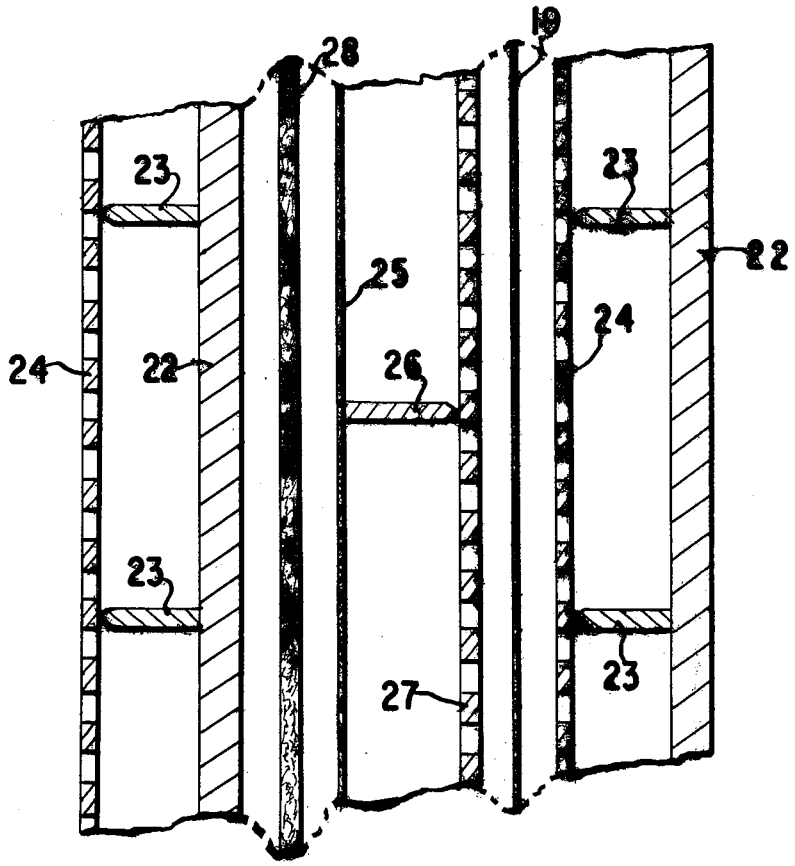
FIG. 4 is a magnified detail of a composite bipolar wall according to another preferred embodiment of the invention.

According to another embodiment of the present invention shown in FIG. 4, a compressible resilient mat is interposed between the adjacent surfaces of the two metal sheets forming the bipolar wall. With reference to FIG. 4, the bipolar wall consists of a steel or other suitable material cathodic sheet 22 to which cathodic screen 24 is connected by means of steel ribs 23, and anodic plate 25 made of titanium or other valve metal resistant to the anodic conditions to which anodic screen 27 is connected by means of titanium or other valve metal ribs 26, a compressible resilient element 28 made of an electrically conducting material interposed between the adjacent surfaces of the two metal sheets 22 and 25. The compressible element is preferably constituted of a metal wire fabric of copper, steel, nickel, or other electrically conducting metal exhibiting good elasticity. The fabric may consist of a series of helicoidal interlaced coils or of a knitted mesh crimped by forming, so that every wire forms a series of waves having an amplitude corresponding to the maximum height of the crimping of the knitted mesh or fabric. One or more knitted meshes or fabrics may be superimposed between the two sheets 22 and 25 to have the desired thickness and resiliency. The uncompressed thickness of resilient element 28 is generally in the range of 2 to 10 mm and more preferably between 3 and 5 mm.

When the electrolyzer is assembled, the resilient element 28 is compressed between the adjacent surfaces of the metal sheets 22 and 25 as the membrane is compressed between the electrode mesh structure 24 and 27 or alternately by pressurizing the electrode compartments during operation as described hereinbefore. Electrical current is transmitted through the resilient element 28 from the cathodic plate 22 to the anodic plate 25 through the multiple contact points between the metal wire coils and the surfaces of the two metal sheets. The resiliency of element 28 ensures a uniform contact pressure in the long run even in the presence of thermal expansions of the cells stack due to varying temperatures of operation.

A further advantage is represented by the fact that the resilient element is readily deformable and therefore easily adapts itself to the inevitable small deviations from perfect planarity of the adjacent surfaces of metal sheets 22 and 25. The resilient element usually undergoes a deformation not higher than 75% of its uncompressed thickness under the pressure applied against plates 22 and 25 upon the assembly of the electrolyzer or under pressurization of the electrode compartments in the range of 100 to 2000 $g/cm^2$ of superatmospheric pressure.

The resilient element 28 may also be made of other resilient and electrically conductive material such as, for example, metal, wool, metal shavings and so on, but preferably it is a metal wire fabric having a wire diameter of 0.1 to 0.7 mm. Particularly suitable materials are described in the U.S. patent application Ser. No. 102,629 filed on Dec. 11, 1979 referred to above and whose description is herewith incorporated by express reference.

While the examples of particularly preferred embodiments of the invention illustrated in the figures show the bipolar walls being formed by two sheets of different metals, with or without the interposition of a resilient layer between them, it will be obvious to the expert that three or more sheets may also be used. For example, in particular uses of the electrolyzer, it may be necessary to provide for all surfaces exposed to the catholyte to be made of special material such as, for example, of nickel. In this case, it will be advantageous to use a bipolar wall formed by three sheets of different metals, wherein both the anodic sheet and the cathodic sheet are relatively thin and are pressed against the opposite surfaces of a thicker plate of a base metal such as steel which provides the necessary structural strength and rigidity of the bipolar wall assembly.

According to the process of the invention for the electrolysis of aqueous alkali metal halide solutions, brine having a concentration of at least 140 g/l and preferably comprised between 150 and 250 g/l is continuously fed into the anode compartments of the electrolyzer and depleted brine together with evolved halogen gas is recovered through the outlet ports of each anode compartment. Water or dilute caustic is continuously fed into the cathode compartments of the electrolyzer and concentrated caustic together with evolved hydrogen gas is recovered through the outlet ports of each cathode compartment.

Various modifications of the process of the apparatus of the invention may be made without departing from the the spirit or scope thereof and it is to be understood that the invention is intended to be limited only as defined in the appended claims.

I claim:

1. A bipolar electrolysis cell of the diaphragm type comprising a frame made of an electrically inert material provided with means to introduce and remove anolyte and catholyte, and anodic endplate, a cathodic endplate and at least one polar element comprised of abutting cathodic plate and anodic plate having secured thereto the cathode structure and the anode structure respectively, the said plates of the bipolar element being held in electrical contact with each other by means of pressure applied by a resilient mat coextensive with the cell area which is compressed upon assembly of the electrolyzer.

2. The electrolyzer of claim 1 wherein the resilient mat is placed between the diaphragm and the cathode.

3. The electrolyzer of claim 1 wherein the resilient mat is placed between the abutting surfaces of two plates of different metals forming the bipolar wall.

4. The electrolyzer of claim 1 wherein the amount of pressure is between 100 and 2000 g/cm$^2$.

5. The electrolyzer of claim 1 wherein at least one of the abutting surfaces of the plates forming the bipolar walls is coated with a layer of metal selected from the group consisting of copper, tin, nickel, silver and platinum.

6. The electrolyzer of claim 1 wherein the resilient mats are made of a fabric of metal wire.

7. A method of electrolyzing an aqueous alkali metal halide solution comprising feeding an aqueous alkali metal halide solution to an electrolyzer of claim 1 while impressing an electrolysis current thereon and recovering the halogen.

8. The method of claim 7 wherein the halide is chloride and chlorine is recovered.

9. A bipolar element for an electrolysis cell comprising a cathodic plate having secured thereto a cathode structure and an anodic plate having secured thereto an anode structure and a resilient mat between surfaces of the anodic plate and cathodic plate abutting opposite sides of the resilient member.

10. The bipolar element of claim 9 wherein the resilient mat is a fabric of metal wire.

11. The bipolar element of claim 9 wherein the uncompressed thickness of the resilient mat is 2 to 10 mm.

12. The bipolar element of claim 11 wherein the uncompressed thickness is 2 to 5 mm.

13. A bipolar electrolysis cell of the diaphragm type comprising a frame made of an electrically inert material provided with means to introduce and remove anolyte and catholyte in an anodic compartment and a cathodic compartment respectively, an anodic endplate, a cathodic endplate and at least one bipolar element comprised of abutting cathodic plate and anodic plate having secured thereto the cathode structure and the anode structure respectively, the said plates of the bipolar element being held in electrical contact with each other by means of pressure obtained by pressurizing both the anodic and the cathodic compartments.

14. The electrolyzer of claim 13 wherein one of the plates forming the bipolar element is more flexible than the other plate.

* * * * *